US005413240A

United States Patent [19]

Hunter et al.

[11] Patent Number: 5,413,240

[45] Date of Patent: May 9, 1995

[54] REPLACEABLE CLOSURE SYSTEM

[75] Inventors: John Hunter, Placerville; Charles Hudson, Rowland Hts.; Michael McGrath, Colton, all of Calif.

[73] Assignee: Russell-Stanley Corporation, Red Bank, N.J.

[21] Appl. No.: 123,426

[22] Filed: Sep. 17, 1993

[51] Int. Cl.[6] ..... B65D 51/18

[52] U.S. Cl. ..... 220/254; 220/284; 220/601

[58] Field of Search ..... 220/254, 284, 288, 304, 220/601, 661; 81/461

[56] References Cited

U.S. PATENT DOCUMENTS

| | | | |
|---|---|---|---|
| 1,956,135 | 4/1934 | Schmitz et al. | 220/39 |
| 2,187,503 | 1/1940 | Sheridan | 220/284 |
| 2,600,924 | 6/1952 | Royer et al. | 81/461 |
| 3,086,679 | 4/1963 | Bijvoet | 220/254 |
| 3,167,210 | 1/1965 | Carney, Jr. | 220/63 |
| 3,262,628 | 7/1966 | Heisler et al. | 229/14 |
| 3,380,618 | 4/1968 | Phillips | 220/254 |
| 3,409,201 | 11/1968 | Carpenter, Jr. | 229/14 |
| 4,002,345 | 1/1977 | Jankowiak et al. | 277/110 |
| 4,114,779 | 9/1978 | Stoll, III | 220/254 |
| 4,164,304 | 8/1979 | Roberson | 220/465 |
| 4,223,799 | 9/1980 | Eyster et al. | 220/284 |
| 4,466,314 | 8/1984 | Rich | 81/461 |
| 4,524,883 | 6/1985 | Herring | 220/462 |
| 4,573,605 | 3/1986 | Udell | 220/304 |
| 4,620,641 | 11/1986 | Beer | 220/284 |
| 4,635,814 | 1/1987 | Jones | 220/403 |
| 4,785,963 | 11/1988 | Magley | 220/284 |
| 4,899,780 | 2/1990 | Aström | 220/284 |
| 5,046,634 | 9/1991 | McFarlin et al. | 220/465 |
| 5,065,883 | 11/1991 | Udell | 220/284 |
| 5,222,620 | 6/1993 | Lima et al. | 220/404 |

FOREIGN PATENT DOCUMENTS

| | | | |
|---|---|---|---|
| 1254911 | 11/1957 | France . | |
| 1221198 | 5/1960 | France | 220/254 |
| 1331437 | 5/1962 | France . | |

*Primary Examiner*—David T. Fidei
*Attorney, Agent, or Firm*—Hedman, Gibson & Costigan

[57] ABSTRACT

A drum closure system is provided for protecting the integrity of the threads of a drum neck and for providing the safe and easy installation of a replaceable closure neck. The drum closure system primarily comprises a drum with a drum neck integrally formed in the drum top, a closure plug, a replaceable closure neck which is interposed threadably between the drum neck and the closure plug, and a specialized tool for installing and removing the replaceable closure neck. The use of the tool, which is designed to enable exertion of very high levels of torque on the replaceable neck, eliminates the need for a locking mechanism between the replaceable neck and drum neck because insertion of the replaceable neck at a high torque measurement virtually eliminates the possibility of relative rotation of the replaceable neck without the specialized tool. Installation of the closure plug makes the removal of the replaceable neck virtually impossible.

4 Claims, 4 Drawing Sheets

REPLACEABLE CLOSURE SYSTEM

FIELD OF THE INVENTION

This invention relates generally to container closures, and more particularly to a replaceable closure system for plastic drums.

BACKGROUND OF THE INVENTION

For some time drums formed of plastic materials have been used to store and ship liquids and other fluid materials. A drawback of using either an all plastic container or a composite container with a plastic liner is the difficulty of preserving the integrity of the closure arrangement. For example, polyethylene drums used in the petroleum industry are often damaged in the area of the bung threads when steel tubes are inserted in the normal course of filling or dispensing. These drums may not be salvageable when attempts are made to refurbish or recondition them. This is inefficient and extremely costly.

Although efforts have been made to incorporate replaceable necks or closure arrangements in an effort to address this problem, no satisfactory method has been developed to enable the easy and safe removal of the replaceable necks. For example, U.S. Pat. No. 4,573,605, (Udell, Mar. 4, 1986) employs a locking tab arrangement to secure a neck to a drum bung. This arrangement necessitates detaching a lock tab from an adaptor flange in order to remove the neck from the bung. This method of removal requires a cutting tool that can be unsafe.

SUMMARY OF THE INVENTION

It is an objective of the invention to provide a replaceable drum closure system including a replaceable neck which can be safely removed from the drum.

It is a further objective of the invention to provide a replaceable neck which fits into a neck integrally formed in the top of a drum and which also accommodates a standard threaded plug within the inside circumference of the neck.

It is a further objective of the invention to provide a specialized tool which securely and safely installs and safely removes the replaceable neck.

It is a further objective of the invention to provide a replaceable neck which can be recycled along with the entire drum assembly.

To these ends the novel closure system includes a replaceable intermediate closure device which is adapted to be threadably received into an internally threaded neck integrally formed in the top of a container such as a plastic drum. The replaceable intermediate closure device has a centrally disposed opening with internal threads adapted to mate with and receive a conventional externally threaded closure plug.

The replaceable intermediate closure device or removable neck is provided with external buttress threads to mate with internal buttress threads on the neck integrally formed in the drum. The removable neck has two annular flanges, one outwardly extending flange located on the top wall of the removable neck and one lower internally-extending flange located below the internal threads. Oriented around the circumference of these flanges is an array of evenly-spaced semicircular notches. Into these notches fit the pins of a specialized spanner tool which is essential for proper installation of the replaceable neck. Specifically, the spanner tool enables the safe application of the high torque necessary in installing the neck to prevent relative rotation of the neck during normal use.

DESCRIPTION OF THE DRAWINGS

The present invention will be better understood when considered with the accompanying drawings wherein.

It will be understood that, for purposes of clarity, certain elements may have been intentionally omitted from certain views where each are illustrated to better advantage in other views.

DESCRIPTION OF THE PREFERRED EMBODIMENT

The assembly of the present invention is comprised of a neck N integrally formed in the top of a drum D, a replaceable neck R, a conventional plug P and a specially designed spanner tool W. The neck N, replaceable neck R and drum D are all formed of high density polyethylene.

Figure 1:
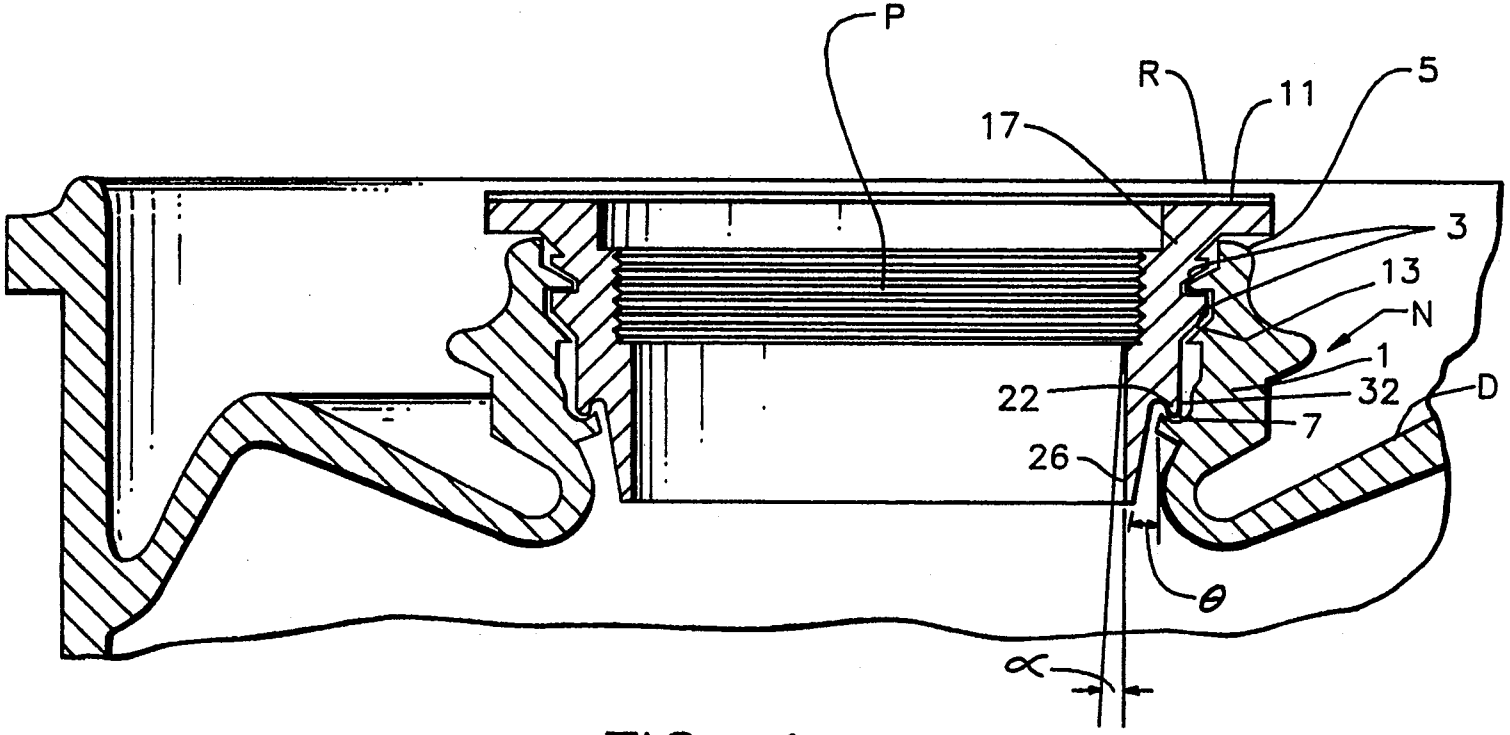
FIG. 1 is a vertical sectional view of the replaceable neck inserted in the neck integrally formed in the drum.

The integrally formed neck N seen in FIG. 1 is comprised of a body section 1 having internally formed buttress threads 3, an upper surface 5 and a seat 7. The seat 7 is configured to provide a bearing surface for the replaceable neck R.

Figure 2:
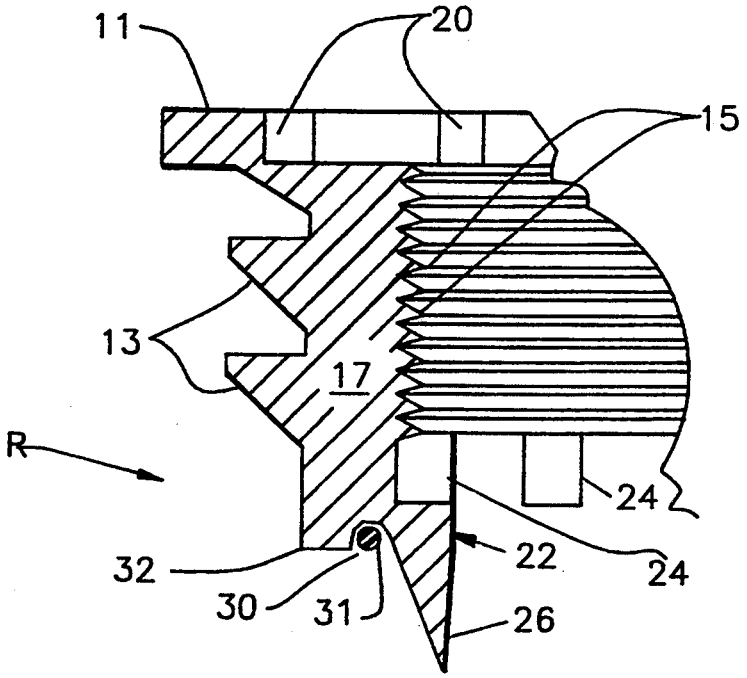
FIG. 2 is an enlarged fragmentary vertical sectional view of the replaceable neck embodying features thereof.
Figure 3:
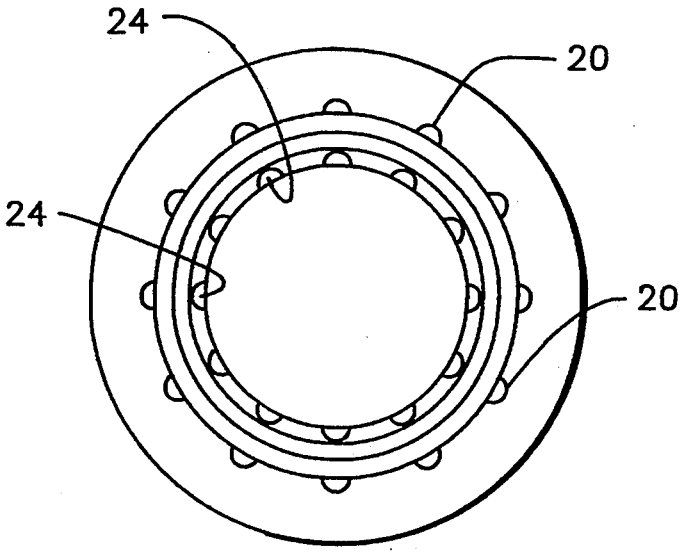
FIG. 3 is a top plan view of the replaceable neck.

As best seen in FIGS. 1 and 2, the replaceable neck R includes an annular top wall or flange 11 and a cylindrical skirt 17 with external threads 13 and internal threads 15. The cylindrical skirt 17 depends from the flange. 11. As seen in FIGS. 2 and 3, the inner circumference of the annular flange 11 has distributed within it an array of evenly spaced semicircular notches or recesses 20. Immediately below the internally threaded portion of the cylindrical skirt is an internally extending annular flange 22, in which another array of evenly spaced semicircular notches or recesses 24 is provided.

Figure 4:
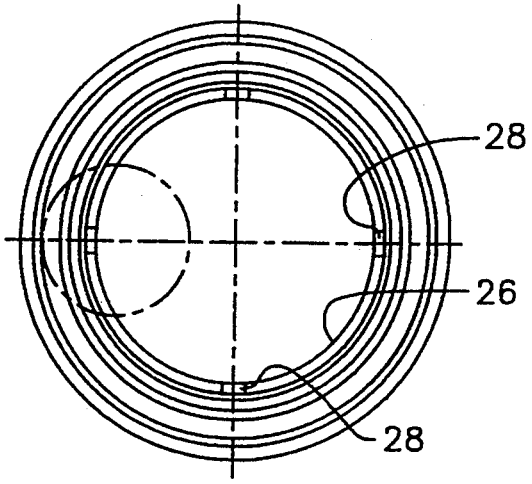
FIG. 4 is a bottom plan view of the replaceable neck shown in FIG. 3.

Depending from the lower portion of the cylindrical skirt 17 and the internally extending annular flange 22 is another cylindrical skirt 26. This lower skirt 26 is of the same inner circumference as the annular flange 22. The inner circumference of the skirt 26 increases in a tapering fashion from the point of attachment to the lower portion of the threaded cylindrical skirt 17 to the bottom of the skirt 26, said taper shown as angle a. The outer circumference of the skirt 26 decreases in a tapering fashion from the point of attachment to the lower portion of the threaded cylindrical skirt 17 to the bottom of the skirt 26 said taper shown as e. As best seen in FIG. 4, four evenly spaced arch-shaped notches or cutouts 28 are disposed along the circumference of the lower skirt 26. The notches 28, which serve as drains, extend vertically from the bottom edge of the lower skirt 26 to a point Just short of the point of attachment between the threaded cylindrical skirt 17 and the lower skirt 26.

As best seen in FIG. 2, an annular recess 30 is formed in the flange 22 and is interposed between the outer circumference of the lower skirt 26 and the outer edge 32 of the flange 22. A gasket 31 fits within the annular recess 30 when the replaceable neck R is installed in the drum neck N to provide sealing engagement between the drum neck N and the replaceable neck R. The lower skirt 26 acts as a guide to properly thread the replaceable neck R into the drum neck N.

Referring to FIG. 1 the system is assembled by threading the replaceable neck R into the drum neck N formed in a container or drum D and is sealed relative to the drum neck N by applying high torque to force the replaceable neck flange 22 against the drum neck seat 7. A conventional closure plug P is then threadably inserted into the replaceable neck R.

Figure 6:
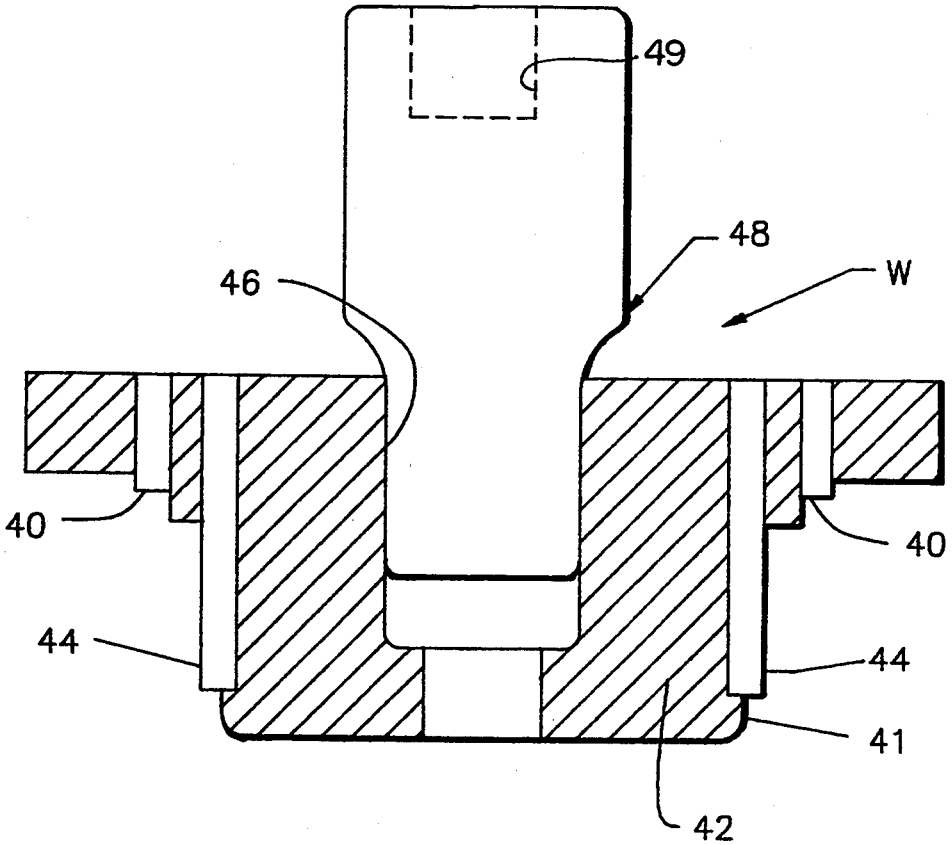
FIG. 6 is a sectional elevational view taken through line 6—6 of FIG. 5.
Figure 5:
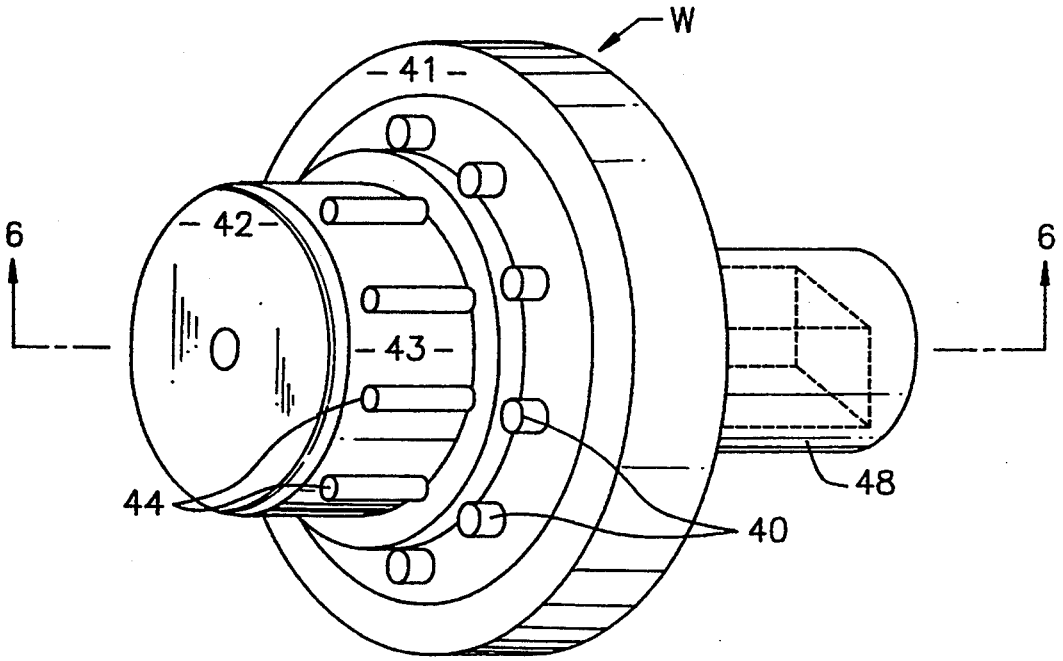
FIG. 5 is an isometric view of the spanner tool.

Installation of the replaceable neck R in a manner which prevents relative rotation between the replaceable neck R and the drum neck N is achieved by means of simply tightening the replaceable neck with sufficient torque to ensure that no relative rotation will occur. The high torque necessary to achieve this result is applied by means of a specialized spanner tool which is uniquely suited to the replaceable neck system. As best seen in FIGS. 5 and 6, the spanner tool W is substantially cylindrical and comprises a top surface 41 and a lower cylindrical surface 43. A hollow area 46 disposed centrally in the tool W and extending vertically downwardly through the center of the tool W accommodates a driver 48 provided to deliver torque. The driver member 48 is force fit into the centrally disposed area 46. A hollow area 49 in the driver 48 is configured in a shape other than circular to receive a moment arm (not shown). A square (as seen in FIGS. 5 and 6), cruciform or hexagonal shaped area will provide a configuration that will enable force to be transmitted from the moment arm to the driver assembly and ultimately to the spanner tool W. Depending downwardly from the top surface 41 of the spanner tool W is an annular array of evenly-spaced pins 40 which correspond to the topmost array of evenly-spaced notches 20 located along the inside circumference of the flange 11 on the replaceable neck R. Oriented around the periphery of the lower cylindrical surface 43 and in proximity to the bottom portion 42 of the tool W is another annular array of evenly-spaced pins 44 which correspond to the lower series of evenly-spaced notches 24 located on the internally-extending annular flange 22. When the spanner tool W is inserted into the replaceable neck R, the pins 40 and 44 of the tool W seat tightly in the respective notches 20 and 24 of the replaceable neck R, allowing for extremely high torque levels to be achieved when installing the replaceable neck R. The two-level pin-notch arrangement avoids stripping of the notches 20 and 24 upon installation and removal is safer than conventional arrangements of the prior art in that no unsafe cutting tool is required.

Once the replaceable neck R is tightened with sufficient torque, and the plug installed, it is virtually impossible to remove the neck. The neck cannot be removed unless the plug P is removed and the spanner tool W employed. Practice has shown that a torque of 65–70 foot-pounds will effect a properly secured replaceable neck R.

The structure of the replaceable neck allows the use of a standard cap seal over the closure plug, conventionally crimped over the flange 11 of the replaceable neck R.

Thus, the invention provides a unique intermediate replaceable neck system which serves to protect the inner threads of a drum neck and which provides a safe method for the removal and installation of the replaceable neck and further which is amenable to use with standard closure plugs and cap seals. The invention also provides a structure in which the drum D, drum neck N and replaceable neck R are all formed of high density polyethylene thereby facilitating grinding of the composite assembly to destroy the drum and reuse the high density polyethylene material in another molding operation.

We claim:

1. A closure system for a container comprising
   (a) a container having an integral cylindrical neck with internal threads for threadably receiving a closure member with external threads;
   (b) a closure plug having external threads;
   (c) a replaceable closure member having an upper cylindrical skirt with external and internal threads and a lower unthreaded cylindrical skirt, said internal threads for threadably receiving said closure plug with external threads; and
   (d) a means for tightening the replaceable closure member to a torque measurement of greater than 65 ft lbs comprising a specialized tool;

wherein said replaceable closure member comprises an annular upper flange extending radially outwardly from the top of said upper cylindrical skirt, the inner circumference of the annular flange having distributed within said inner circumference a series of evenly-spaced semicircular notches, and an annular lower flange extending radially inwardly from said upper cylindrical skirt, the inner circumference of the annular lower flange having distributed within said inner circumference a series of evenly spaced semicircular notches.

2. A closure system according to claim 1 wherein said specialized tool comprises an upper body member; an annular array of evenly-spaced pins depending downwardly from said upper body which array of pins correspond to the notches of the annular flange located at the top of said upper cylindrical skirt, a lower body section; and a second annular array of evenly-spaced pins formed on the surface of said lower body which second array of pins correspond to the notches of said annular lower flange.

3. A tool according to claim 2 wherein the specialized tool has disposed centrally on its top a hollow area which extends vertically downward through the center of the tool to accommodate a driver.

4. In a closure system for preserving a closure fitting on a plastic drum having an integrally threaded neck projecting therefrom for receiving an externally threaded replaceable intermediate closure device adapted to be threadably interposed between said container neck and a closure plug, a tool adapted to install said replaceable intermediate closure device, said tool comprising:
   (a) an upper body;
   (b) an evenly-spaced array of external pins depending vertically downwardly from said upper body, said pins corresponding to notches in the interior of said replaceable intermediate closure device;
   (c) a lower body;
   (d) a second annular array of pins formed on the circumference of said body, said second annular array of pins corresponding to notches in said replaceable intermediate closure device; and
   (e) a hollow area centrally disposed on the top of said cylindrical body, extending vertically down the central axis of said cylindrical body, to accommodate a driver.

* * * * *